United States Patent [19]

Plank et al.

[11] 4,276,151

[45] Jun. 30, 1981

[54] NOVEL REFORMING CATALYSTS

[75] Inventors: Charles J. Plank, Woodbury; Edward J. Rosinski, Pedricktown, both of N.J.; Edwin N. Givens, Bethlehem, Pa.

[73] Assignee: Mobil Oil Corporation, New York, N.Y.

[21] Appl. No.: 134,818

[22] Filed: Mar. 28, 1980

Related U.S. Application Data

[63] Continuation-in-part of Ser. No. 86,565, Oct. 19, 1979, abandoned, which is a continuation of Ser. No. 723,847, Sep. 16, 1976, abandoned, which is a continuation of Ser. No. 503,542, Sep. 4, 1974, abandoned, which is a continuation-in-part of Ser. No. 262,410, Jun. 13, 1972, abandoned.

[51] Int. Cl.[3] ..... C10G 35/06

[52] U.S. Cl. ..... 208/138; 208/135; 208/139

[58] Field of Search ..... 208/135, 138

[56] References Cited

U.S. PATENT DOCUMENTS

| | | | |
|---|---|---|---|
| Re. 30,157 | 11/1979 | Burress | 585/481 |
| 3,301,917 | 1/1967 | Wise | 585/739 |
| 3,499,836 | 3/1970 | Hayes et al. | 208/138 |
| 3,544,451 | 12/1970 | Mitsche et al. | 208/138 |
| 3,700,585 | 10/1972 | Chen et al. | 208/111 |
| 3,702,886 | 11/1972 | Argauer | 252/455 Z |
| 3,709,979 | 1/1973 | Chu | 423/328 |
| 3,756,942 | 9/1973 | Cattanach | 208/138 |
| 3,758,402 | 9/1973 | Olec | 208/111 |
| 3,775,501 | 11/1973 | Keeding et al. | 585/414 |
| 3,821,105 | 6/1974 | Mitsche et al. | 208/138 |
| 3,846,343 | 11/1974 | Erickson et al. | 208/138 |
| 3,890,218 | 6/1975 | Morrison | 208/135 |
| 3,907,663 | 9/1975 | Owen | 208/70 |

*Primary Examiner*—Curtis R. Davis

*Attorney, Agent, or Firm*—Charles A. Huggett; Michael G. Gilman; Claude E. Setliff

[57] ABSTRACT

ZSM-5 type zeolites as more specifically defined hereinabove, are added to reforming catalysts in order to produce a new catalyst composition with high catalytic activity and excellent selectivity. These new catalysts when utilized in reforming naphtha, reduce the $C_1$ plus $C_2$ concentrations in reformer gas product, while increasing the $C_3$ plus $C_4$ concentrations.

8 Claims, No Drawings

NOVEL REFORMING CATALYSTS

CROSS-REFERENCE TO RELATED APPLICATIONS

This is a continuation-in-part of application Ser. No. 086,565, filed Oct. 19, 1979, which in turn is a continuation of application Ser. No. 723,847, filed Sept. 16, 1976, which in turn is a continuation of application Ser. No. 503,542, filed Sept. 4, 1974, which in turn is a continuation-in-part of application Ser. No. 262,410, filed June 13, 1972, all of which are now abandoned.

BACKGROUND OF THE INVENTION

1. Field of the Invention

This invention relates to a reforming process utilizing as a catalyst a composite of ZSM-5 type zeolite and a conventional reforming catalyst such as platinum-rhenium on alumina.

2. Description of the Prior Art

Catalytic reforming of naphtha feed stocks has long been known in the petroleum industry. Most naphtha feeds contain large amounts of naphthenes and paraffins and consequently have low octane numbers. By means of various hydrocarbon conversion reactions, catalytic reforming has improved the octane number of naphtha feed stocks. Some of the more important conversion reactions that take place during catalytic reforming are dehydrogenation of naphthenes to aromatics, dehydrocyclization of paraffins to iso-paraffins. A less desirable reaction that also occurs during reforming is the hydrocracking of long chain paraffins to gaseous hydrocarbons such as methane and ethane.

The above reforming reactions have previously been catalyzed by catalysts comprising porous supports, such as alumina, that have dehydrogenation promoting metal components impregnated or admixed with the support. Platinum on alumina and, more recently, bimetallics, such as platinum and rhenium on alumina, are examples of these catalysts.

Reforming catalysts should possess high selectivity, high activity and good stability. Selectivity in reforming is the ability of a catalyst to selectively produce high yield of high octane products, such as aromatics, from compounds that have relatively low octane numbers, such as naphthenes and paraffins. The activity of a catalyst is the ability to convert the feed stock into all products without regard to selectivity. A stable catalyst is highly desirable so that the activity and selectivity characteristics of a catalyst can be maintained during prolonged periods of operation.

It is known in the art to admix certain zeolites with other catalysts. For instance, British Pat. No. 1,056,493 discloses mixing together an alumina-supported platinum catalyst and a chabazite zeolite and using it in a hydrocracking operation. British Pat. No. 1,255,544 discloses a dual purpose catalyst comprising a zeolite, especially mordenite, having incorporated therein both platinum and rhenium. However, these patents do not suggest the catalysts of this invention since they do not afford the same advantages. The octane number improvement with the catalysts of this invention is significantly greater than can be obtained with those of the British patents mentioned.

U.S. Pat. No. 3,365,392 discloses the catalytic reforming of gasoline charge stock to produce high octane reformate and LPG by contacting a charge with a catalyst comprising a platinum group metal on a support comprising a finely divided crystalline aluminosilicate suspended in alumina matrix. The preferred aluminosilicate is the hydrogen or polyvalent form of mordenite, especially the hydrogen form thereof. A similar disclosure is found in U.S. Pat. No. 3,267,022, except that the conversion process is hydrocracking.

U.S. Pat. No. 3,546,102 is concerned with a hydrocarbon conversion catalyst consisting essentially of a co-catalyst support and a Group VIII metal. The support contains an absorbent refractory inorganic oxide and mordenite structure zeolite. The preferred metal is platinum, and it is incorporated into the zeolite-inorganic oxide blend after blending but before drying and calcining.

Other U.S. Patents disclosing catalytic composites comprising plantinum, or rhenium, or both, optionally a matrix and mordenite as the sole or preferred crystalline aluminosilicate are U.S. Pat. Nos. 3,369,997, 3,376,214, 3,376,215, 3,464,929, 3,511,773, 3,523,914, 3,544,451, 3,562,108 and 3,574,092.

With respect to the disclosures in the patents above respecting the combination of mordenite, matrix and, for example, platinum, it will be shown that such combination does not give the advantages of the composite of the present invention.

U.S. Pat. No. 3,758,402 teaches hydrocracking of hydrocarbons using catalyst composed of two zeolites and, preferably, a matrix material such as alumina. The composite may also contain a hydrogenation-dehydrogenation component such as platinum. The two zeolites are ZSM-5 and an aluminosilicate having a pore size greater than 7 A.

Finally, U.S. Pat. Nos. 3,702,886 and 3,709,979 respectively disclose and claim ZSM-5 and ZSM-11 as novel compositions of matter. The compositions, which are useful in hydrocarbon conversion reactions, especially cracking, may optionally contain a matrix and a hydrogenation-dehydrogenation component. The matrix material may be selected from clays, silica and/or metal oxides.

SUMMARY OF THE INVENTION

The zeolites of this invention are mixed with reforming catalysts yielding a catalyst with improved stability and selectivity.

The catalysts of this invention have the ability to reduce the $C_1$ plus $C_2$ concentration in the effluent gas, while increasing the $C_3$ plus $C_4$ concentrations. This necessarily improves the selectivity of the catalyst and increases the yield of high octane products.

The catalysts are also much more active than the reforming catalysts alone. As a consequence at the same severity level, they will have an enhanced life. At a given severity of operating conditions the liquid products have significantly high octane numbers and the yield yields of $C_3$ plus $C_4$ are much larger for catalysts of this invention.

The ability of the instant composite to give, at a given octane number for the $C_5$+ liquid product, effluents with reduced $C_1$ plus $C_2$ yields while at the same time giving increased yields of $C_3$ plus $C_4$ hydrocarbons is highly unusual and thus entirely unexpected. As will be seen from the data presented hereinbelow standard reforming catalysts, as for example Pt/Re on alumina, gives very high $C_1$ plus $C_2$ yields with fair to moderate $C_3$ plus $C_4$ yields using the composite of this invention, one would expect a corresponding increase in $C_1$'s and $C_2$'s. That an increase in $C_1$ plus $C_2$ yields is not attained is highly suggestive of an unusual result.

The process of this invention is important economically since $C_3$ and $C_4$ hydrocarbons are generally more valuable than $C_1$ and $C_2$ hydrocarbons. As a matter of fact, $C_1$ and $C_2$ products obtained in the reforming process are usually burned or "flared" since it is not feasible, from a profitability standpoint, to recover them. On the other hand it is profitable to recover the $C_3$ and $C_4$ hydrocarbons and to derive useful products therefrom. In preparing such useful products, the $C_3$'s and $C_4$'s may first be separated from the gaseous effluent, the $C_3$'s being further separated for use as LPG. The $C_4$'s themselves, upon separation yield an iso $C_4$ useful in certain alkylation reactions.

DESCRIPTION OF THE INVENTION

Typical reforming catalysts that may be employed in this invention include the platinum group reforming catalysts. They may include for example, alumina in the eta, chi, or gamma form and mixtures thereof in combination with a nobel metal. The phrase "platinum group" includes, for example, platinum, palladium, osmium, iridium, ruthenium, or rhodium and mixtures thereof with each other or with other metals of Group VII-B, including rhenium, deposited on a suitable support. Generally, the major portion of the catalyst will be alumina, which may comprise as much as about 95% by weight or more of the catalyst. Other components may be combined with the alumina carrier, such as oxides of silicon, magnesium, zirconium, thorium, vanadium, titanium, boron or mixtures thereof. The platinum-alumina combination, either with or without one or more of the above listed components such as silica, may also be promoted with small amounts of halogen such as chlorine and fluorine in amounts ranging from about 0.01% up to about 5% by weight. Generally, less than about 3% of halogen is employed with the platinum group catalyst. In a preferred embodiment, the reforming catalyst carrier material is a relatively high surface area material, preferably an eta-alumina or gamma-alumina material or mixtures thereof having a surface area of at least about 100 square meters per gram. Preparation of the "platinum group" catalyst component may be accomplished by different procedures described in the prior art. In one procedure an alumina carrier material is impregnated with the acid or salt of one or more of the herein described "platinum group" hydrogenating components in amounts that will produce from a fraction of a percent up to about 2% by weight of the metal, but generally not substantially more than about 0.6% by weight of platinum is employed.

It is to be understood that a naturally occurring or a synthetically prepared alumina with or without silica may be employed as a carrier material or support for the platinum group reforming catalyst. Preferably, the platinum—alumina catalyst employed comprises a high surface area material such as a base alumina as discussed above. Before use, the high surface area platinum-containing catalyst may be reduced in a hydrogen atmosphere and maintained preferably in a substantially moisture-free atmosphere before being put on stream.

It is to be further understood that the term "platinum group" reforming catalyst designates a catalyst which performs the well-known reforming reactions of hydroisomerization and aromatization under conditions creating a low (essentially equilibrium) concentration of olefins in the effluent product.

The above "platinum group" catalyst is mixed with about 0.2% to about 15% of the zeolite is mixed with the reforming catalyst. Stillmore preferred is a combination comprising about 1% to about 10% of the zeolite mixed with reforming catalysts. Even more preferably is about 1% to about 10% of the ZSM-5 type zeolte intimately mixed with reforming catalysts under conditions such that the average particle size of the zeolite is not more than 10 microns. These percentages are based on the combined weight of the reforming catalyst plus zeolite. The amount of zeolite that is mixed with the reforming catalyst depends upon the pre-treatment conditions which effect the activity of the ZSM-5 type zeolite.

Representative of the ZSM-5 type zeolites are ZSM-5, ZSM-11, ZSM-12, ZSM-23, ZSM-35 and ZSM-38. ZSM is disclosed and claimed in U.S. Pat. No. 3,702,886 and U.S. Pat. No. Re. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,839 for ZSM-38. The disclosures of these patents are incorporated herein by reference. It is to be understood that by incorporating by reference the foregoing patents to describe examples of specific members of the novel class with greater particularity, it is intended that identification of the therein disclosed crystalline zeolites be resolved on the basis of their respective X-ray diffraction patterns. As discussed above, the present invention contemplates utilization of such catalysts wherein the mole ratio of silica to alumina is essentially unbounded. The incorporation of the identified patents should therefore not be construed as limiting the disclosed crystalline zeolites to those having the specific silica-alumina mole ratios discussed therein, it now being known that such zeolites may be substantially aluminum-free and yet, having the same crystal structure as the disclosed materials, may be useful or even preferred in some applications. It is the crystal structure, as identified by the X-ray diffraction "fingerprint", which establishes the identity of the specific crystalline zeolite material.

The family of ZSM-5 compositions has the characteristic x-ray diffraction pattern as set forth in Table 1 hereinbelow. They can also be identified in terms of mole ratios of oxides as follows:

$$0.9\pm0.2M_{2/n}O:W_2O_3:>5YO_2:zH_2O$$

wherein M is a cation, n is the valence of said cation, W is selected from the group consisting of aluminum and gallium, Y is selected from the group consisting of silicon and germanium, and z is from 0 to 40.

Preferably the mole ratios of oxides will be as follows:

$$0.9\pm0.2M_{2/n}O:W_2O:5\text{-}300YO_2:zH_2O$$

where M, n, W, Y and z are as just defined. In a preferred synthesized form, the zeolite has a formula, in terms of mole ratios of oxides as follows:

$$0.9\pm0.2M_{2/n}O:Al_2O:5\text{-}100SiO_2:zH_2O$$

and M is selected from the group consisting of a mixture of alkali metal cations, especially sodium, and alkylammonium cations, the alkyl groups of which preferably contain from 2 to 5 atoms.

In a preferred embodiment of ZSM-5, W is aluminum, Y is silicon and the silica/alumina mole ratio is above 5 and generally at least 10 and can range up to 1500.

Members of the family of ZSM-5 zeolites possess a definite distinguishing crystalline structure whose x-ray diffraction pattern shows the following significant lines:

TABLE 1

| Interplanar Spacing d (A) | Relative Intensity |
|---|---|
| 11.1 ± 0.2 | S |
| 10.0 ± 0.2 | S |
| 7.4 ± 0.15 | W |
| 7.1 ± 0.15 | W |
| 6.3 ± 0.1 | W |
| 6.04 ± 0.1 | W |
| 5.97 ± 0.1 | W |
| 5.56 ± 0.1 | W |
| 5.01 ± 0.1 | W |
| 4.60 ± 0.08 | W |
| 4.25 ± 0.08 | W |
| 3.85 ± 0.07 | VS |
| 3.71 ± 0.05 | S |
| 3.64 ± 0.05 | M |
| 3.04 ± 0.03 | W |
| 2.99 ± 0.02 | W |

These values as well as all other x-ray data were determined by standard techniques. The radiation was the K-alpha doublet of copper, and a scintillation counter spectometer with a strip chart pen recorder was used. The peak heights, I, and the positions as a function of 2 times theta, where theta is the Bragg angle, were read from the spectrometer chart. From these relative intensities, 100 where I is the intensity of the strongest line or peak, and d (obs.), the interplanar spacing in A, corresponding to the recorded lines, were calculated. In Table 1 the relative intensities are given in terms of the symbols S=strong, W=weak, M=medium and VS=very strong. It should be understood that this x-ray diffraction pattern is characteristic of all the species of ZSM-5 compositions. Ion exchange of the sodium ion with cations reveals substantially the same pattern with some minor shifts in interplanar spacing and variation in relative intensity. Other minor variations can occur depending for example, on the silica to alumina ratio of the particular sample and upon whether or not it has been subjected to thermal treatment.

In this regard, when the ammonium or acid (H) forms of ZSM-5 are thermally treated, their molecular formulas can change with respect to the $M_{2/n}O:Al_2O_3$ ratio, so that the new ratio becomes $0.6\pm0.5M_{2/n}O:Al_2O_3$, without any significant change in their x-ray patterns. These materials are still crystalline ZSM-5 zeolites.

Zeolite ZSM-5 can be suitably prepared by preparing a solution comprising water, tetrapopyl ammonium hydroxide and sources of sodium oxide, an oxide of aluminum or gallium and an oxide of silicon, and having a composition in terms of mole ratios of oxides, falling within the following ranges:

TABLE 2

| | Broad | Preferred | Particularly Preferred |
|---|---|---|---|
| $OH/SiO_2$ | 0.07–1.0 | 0.1–0.8 | 0.2–0.75 |
| $R_4N/(R_4N^+ + Na^+)$ | 0.2–0.95 | 0.3–0.9 | 0.4–0.9 |
| $H_2/OH-$ | 10–300 | 10–300 | 10–300 |
| $YO_2/W_2O_3$ | 5–100 | 10–60 | 10–40 |

wherein R is propyl, W is aluminum and Y is silicon. This mixture is maintained at reaction conditions until the crystals of the zeolite are formed. Thereafter the crystals are separated from the liquid and recovered. Typical reaction conditions consist of a temperature of from about 75 C. to 175 C. for a period of about six hours to 60 days. A more preferred temperature range is from about 90 to 150 C., with the amount of time at a temperature in such range being from about 12 hours to 20 days.

The digestion of the gel particles is carried out until crystals form. The solid product is separated from the reaction medium, as by cooling the shole to room temperature, filtering and water washing.

ZSM-5 is preferably formed as an aluminosilicate. The composition can be prepared utilizing materials which supply the elements of the appropriate oxide. Such compositions include, for an aluminosilicate, sodium aluminate, alumina, sodium silicate, silica hydrosol, silica gel, silicic acid, sodium hydroxide and tetrapropylammonium compounds. It will be understood that each oxide component utilized in the reaction mixture for preparing a member of the ZSM-5 family can be supplied by one or more initial reactants and they can be mixed together in any order. For example, sodium oxide can be supplied by an aqueous solution of sodium hydroxide, or by an aqueous solution of sodium silicate; tetrapropylammonium cation can be supplied by the bromide salt. The reaction mixture can be prepared either batchwise or continuously. Crystal size and crystallization time of the ZSM-5 composition will vary with the nature of the reaction mixture employed.

Zeolite ZSM-5 may also be prepared, in situ, by preparing a solution containing sources of silica, alumina, alkali, water and precursors to organo-ammonium cation. These precursors consist of compounds characterized by the formulas: $R_1R_2R_3N$ where $R_1$, $R_2$, and $R_3$ are selected from the consisting of aryl, substituted aryl, alkyl, substituted alkyl, cycloalkyl, substituted cycloalkyl, and hydrogen and $R_4X$, where $R_4$ is selected from the group consisting of alkyl, substituted alkyl, cycloalkyl, substituted cycloalkyl, aryl and substituted aryl and X is an electronegative group. It is to be noted that the precursor to the organo-ammonium compound can be entirely made up of the compound characterized by the formula: $R_1R_2R_3N$.

This is situ formation of the highly substituted cation may be represented by the following equation:

$$R_1R_2R_3N+R_4X[R_1R_2R_3//R_4+N]X$$

where $R_1$, $R_2$, and $R_3$ are selected from the group consisting of alkyl, substituted alkyl, aryl, substituted aryl, cycloalkyl, substituted cycloalkyl, and hydrogen and $R_4$ is selected from the group consisting of alkyl, substituted alkyl, cycloalkyl, substituted cycloalkyl, aryl, and substituted aryl and X is a hydroxy or a group such as chloride, bromide, iodide, sulfate, phosphate, sulfonate, sulfite, carboxylate and carbonate. This alkali, water, $SiO_2$ and $A_2O_3$. This in situ reaction is highly unexpected in the presence of such alkali.

The compound represented by the formula $R_1R_2R_3N$ may be replaced by compounds that contain nitrogen in an aromatic ring such as pyridine, quinoline, or acridine. The nitrogen may also be contained in a saturated ring such as piperdine or 1, 2, 3, 4 tetrahydroquinoline. Additionally, $R_1R_2R_3N$ may be replaced by a compound that contains two or more nitrogen atoms such as ethylenediamine.

Table 3 lists the broad and preferred ranges for the reaction mixture necessary to synthesize members of the ZSM-5 type (i.e. ZSM-5 and ZSM-11).

TABLE 3

| | | Broad | Preferred |
|---|---|---|---|
| $\frac{R_1R_2R_3N + R_4X}{R_1R_2R_3M + R_4X + M}$ | = | 0.1-0.98 | 0.15-0.80 |
| $\frac{R_4X}{R_1R_2R_3N}$ | = | 0-2 | 0-1.5 |
| $\frac{M_2O}{SiO_2}$ | = | 0.01-0.5 | 0.03-0.3 |
| $\frac{H_2O}{M_2O}$ | = | 50-2,000 | 60-1,000 |
| $\frac{SiO_2}{Al_2O_3}$ | = | 1-300 | 2-150 |

wherein M=alkali metal and at least one of the R groups is preferably $C_3H_7$.

The resulting solutions are stirred thoroughly and crystalized at a temperature above 212° F. and below 700° F. in order to achieve crystalization in less than a week. The temperature is preferably about 250° to 500° F. The reaction is carried out at essentially autogenous pressure of 15 to 500 p.s.i.g. for a time not less than 15 minutes.

Excess pressure due to inert gases in the reaction mixture are not harmful. The reaction is carried out in a closed vessel capable of withstanding the pressures used in this reaction. The resulting solid crystallized aluminosilicate can be removed, filtered and washed with water at about 60° to 200° F.

The zeolites used in the instant invention may have the original cations associated therewith replaced by a wide variety of other cations according to techniques well known in the art. Typical replacing cations would include hydrogen, ammonium, and metal cations including mixtures of the same. Of the replacing cations, particular preference is given to cations of hydrogen, ammonium, rare earth, magnesium, calcium, zinc, copper, silver, platinum, palladium, nickel and mixtures thereof. The metals may be also added by impregnation.

Typical ion exchange techniques include contacting the particular zeolite with a salt of the desired replacing cation or cations. Although a wide variety of salts can be employed, particular preference is given to chlorides, nitrates and sulfates.

Representative ion exchange techniques are disclosed in a wide variety of patents including U.S. Pat. Nos. 3,140,249; 3,140,251; and 3,140,253.

Following contact with the salt solution of the desired replacing cation, the zeolites may be washed with water and dried at a temperature ranging from 150° F. to about 600° F. and thereafter may be heated in air or other inert gas at temperatures ranging from about 500° F. to 1700° F. for periods of time ranging from 1 to 48 hours or more.

It is also possible to treat the zeolite with steam at elevated temperatures ranging from 800° F. to 1600° F. and preferably 1000° F. and 1500° F. if such is desired. The treatment may be accomplished in atmospheres consisting partially or entirely of steam.

A similar treatment can be accomplished at lower temperatures and elevated pressures, e.g. 350°-700° F. at 10 to about 200 atmospheres.

The specific zeolites described, when prepared in the presence of organic cations, are substantially catayticcally inactive, possibly because the intracrystalline free space is occupied by organic cations from the forming solution. They may be activated by heating in an inert atmosphere at 1004° F. (540° C.) for one hour, for example, followed by base exchange with ammonium salts followed by calcination at 1004° F. (540° C.) in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 1004° F. (540° C.) for from about 15 minutes to about 24 hours.

Natural zeolites may sometimes be converted to zeolite structures of the class herein identified by various activation procedures and other treatments such as base exchange, steaming, alumina extraction calcination, alone or in combinations. Natural minerals which may be so treated include ferrierite, brewsterite, stilbite, dachiardite, epistilbite, heulandite, and clinoptilolite.

In a preferred aspect of this invention, the zeolites hereof are selected as those providing among other things a crystal framework density, in the dry hydrogen form, of not less than about 100 lbs. per cubic foot (1.6 grams per cubic centimeter). It has been found that zeolites which satisfy all three of the discussed criteria are most desired for several reasons. When hydrocarbon products or by-products are catalytically formed, for example, such zeolites tend maximize the production of gasoline boiling range hydrocarbon products. Therefore, the preferred zeolites useful with respect to this invention are those having a Constraint Index of about 1 to about 12, a silica to alumina ratio of at least about 12 and a dried crystal density of not less than about 1.6 grams per cubic centimeter.

The "Constraint Index" is calculated as follows:

$$\text{Constraint Index} = \frac{\log_{10}(\text{fraction of hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of 1 to 12. Constraint Index (CI) values for some typical materials are:

| | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| TMA Offretite | 3.7 |
| Clinoptilolite | 3.4 |
| Beta | 0.6 |
| H-Zelon (mordenite) | 0.4 |
| REY | 0.4 |
| Amorphous Silica-Alumina | 0.6 |
| Erionite | 38 |

The above described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables such as crystal size of the zeolite, the presence of occluded contaminants, etc., may affect the constraint index. Therefore, it will be appreciated that it may be possible to so select test conditions as to establish more than one value in the range of 1 to 12 for the Constraint Index of a particular zeolite. Such zeolite exhibits the constrained access as herein defined and is to be regarded as having a Constraint Index in the range of 1 to 12. Also contemplated herein as having a Constraint Index in the range of 1 to 12 and therefore within the scope of the defined novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value within the range of 1 to 12. Thus, it should be understood that the Constraint Index value as used herein is an inclusive rather than an exclusive value. That is, a crystalline zeolite when identified by any combination of conditions within the testing definition set forth herein as having a Constraint Index in the range of 1 to 12 is intended to be included in the instant novel zeolite definition whether or not the same identical zeolite, when tested under other of the defined conditions, may give a Constraint Index value outside of the range of 1 to 12.

With respect to the dry density, this may be calculated for known structures from the number of silicon plus aluminum atoms per 1000 cubic Angstroms, as given, e.g., on Page 19 of the article Zeolite Structure by W. M. Meier. This paper, the entire contents of which are incorporated herein by reference, is included in Proceedings of the Conference on Molecular Sieves, (London, April 1967) published by the Society of Chemical Industry, London, 1968.

When the crystal structure is unknown, the crystal framework density may be determined by classical pyknometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space.

It is possible that the unusual sustained activity and stability of this special class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites, including some which are not within the purview of this invention, are:

| | Void Volume | Framework Density g/cc | lbs/ft$^3$ |
|---|---|---|---|
| Ferrierite | 0.28 cc/cc | 1.76 | 109.9 |
| Mordenite | .28 | 1.7 | 106.1 |
| ZSM-5, -11 | .29 | 1.79 | 111.7 |
| ZSM-12 | — | 1.8 | 112.4 |

-continued

| | Void Volume | Framework Density g/cc | lbs/ft$^3$ |
|---|---|---|---|
| ZSM-23 | — | 2.0 | 124.9 |
| Dachiardite | .32 | 1.72 | 107.4 |
| L | .32 | 1.61 | 100.5 |
| Clinoptilolite | .34 | 1.71 | 106.8 |
| Laumontite | .34 | 1.77 | 110.5 |
| ZSM-4 (Omega) | .38 | 1.65 | 103.0 |
| Heulandite | .39 | 1.69 | 105.5 |
| P | .41 | 1.57 | 98.0 |
| Offretite | .40 | 1.55 | 96.8 |
| Levynite | .40 | 1.54 | 96.2 |
| Erionite | .35 | 1.51 | 94.3 |
| Gmelinite | .44 | 1.46 | 91.2 |
| Chabazite | .47 | 1.45 | 90.5 |
| A | .5 | 1.3 | 81.1 |
| Y | .48 | 1.27 | 79.2 |

Representative ion exchange techniques are disclosed in a wide variety of patents including U.S. Pat. Nos. 3,140,249; 3,140,251; and 3,140,253.

Following contact with the salt solution of the desired replacing cation, the zeolites may be washed with water and dried at a temperature ranging from 150° F. to about 600° F. and thereafter may be heated in air or other inert gas at temperatures ranging from about 500° F. to 1700° F. for periods of time ranging from 1 to 48 hours or more.

It is also possible to treat the zeolite with steam at elevated temperatures ranging from 800° F. to 1600° F. and preferably 1000° F. and 1500° F. if such is desired. The treatment may be accomplished in atmospheres consisting partially or entirely of steam.

A similar treatment can be accomplished at lower temperatures and elevated pressures, e.g. 350°-700° F. at 10 to about 200 atmospheres.

Reforming in the presence of the catalyst described herein generally takes place at about 0.5 to about 50 WHSV, about 800° to about 1050° F., at about 85 to about 500 psig pressure and about 1 to about 10 molar ratio of hydrogen to hydrocarbons. Such conditions are referred to as "reforming conditions." Preferably the WHSV is about 1 to about 20. It is understood that one or more reactors in sequence may be employed in the reforming operation. In practicing this invention the catalyst, whether a physical or an intimate mixture, is used in one or more of the reactors.

The proper balance between the amount of the ZSM-5 component and the reforming catalyst component will depend upon the charge stock and operating conditions. However, it should be noted that one of the advantages of this invention lies in the degree of activity that the ZSM-5 component possesses. This high activity, which will be highest when crystallites are less than about 2 microns in size, preferably less than about 1 micron, in weight mean particle diameter, allows for a high degree of flexibility in catalyst composition and operating conditions including the presence of materials normally thought of as inhibitors in the reforming process. These inhibitors include nitrogen and sulfur containing compounds.

Generally ion exchange, washing, calcination, steaming and other such operations performed on the ZSM-5 zeolite should be carried out prior to combining with the reforming catalyst. Admixture of the ZSM-5 zeolite with the reforming catalyst may be accomplished by physically mixing the same. The ZSM-5 zeolite may be mixed with the reforming catalyst directly or after compositing in a matrix.

When the ZSM-5 catalyst and reforming catalyst are mixed as large particles, for example, greater than about 40 mesh, the ZSM-5 zeolite may be dispersed in a hydrous oxide matrix such as silica, alumina, magnesia and clay. Generally, the amount of ZSM-5 zeolite will fall within the range of from about 0.2% to about 25% by weight of the zeolite-matrix system.

Additionally, the platinum type metal may be added to the ZSM-5 zeolite, either before or after admixture thereof with a matrix. When the composite comprises an intimate mixture of ZSM-5 zeolite and reforming catalyst, the platinum type metal may be combined with the alumina, either before or after incorporation of the ZSM-5 zeolite.

In all these various embodiments, the product selectivity is substantially changed at a given octane number from that given by the reforming catalyst alone at the same octane severity. In all cases the gaseous products are primarily and unexpectedly $C_3$ and $C_4$ rather than $C_1$ and $C_2$. In addition the operating severity needed to reach a given octane number is less for the combination catalyst of this invention than the reforming catalyst alone.

If, on the other hand, one uses the catalyst of this invention at the same operating conditions as for the standard reforming catalyst alone, the resulting liquid product will have a significantly higher octane number than for the standard catalyst and the $C_3+C_4$ yields will far exceed those for the standard catalyst.

The naphtha charge stocks which can be reformed over the catalysts of this invention include those understood in the prior art, namely virgin naphthas, cracked naphthas and partially reformed naphthas.

The following examples will illustrate the advantages of the catalyst of this invention.

EXAMPLE 1

This catalyst was prepared by compositing two separate catalytic components. Each component was separately synthesized as a catalytic material, then composited.

The HZSM-5 component constituting 10% of the total composite was prepared by first synthesizing the ZSM-5 through the reaction of the following solutions:

A. Sodium aluminate solution
- 0.56 lbs. $NaAlO_2$
  - (44.7 wt. % $Al_2O_3$)
  - (33.5 wt. % $Na_2O$)
  - (21.8 wt. % water)
- 14.0 lbs. water B. Sodium silicate solution
- 44.7 lbs. Q-Brand Silicate
  - (28.9 wt. % $SiO_2$)
  - (8.9 wt. % $Na_2O$)
  - (62.2 wt. % water)

C. Quaternary salt solution
- 5.6 lbs. tetrapropylammonium bromide
- 28.0 lbs. water D. Acid Solution
- 4.47 lbs. $H_2SO_4$ 97 wt. %
- 14.0 lbs. water These solutions were mixed together by adding solution C to solution B, then adding solution A to solution BC, followed by adding solution D to solution ABC. All of these solutions were added together while stirring rapidly The resulting mixture was heated to 200°–210° F. and held for 167 hours until the crystalline organoaluminosilicate product formed.

The synthesized ZSM-5 was then washed free of soluble salts, dried, and calcined to remove the combustible organics. The calcined crystalline ZSM-5 was subsequently contacted four times with a hot solution of 5 wt. % ammonium chloride to reduce the residual sodium content to about 0.01 wt. %. Filtration was used to separate the crystallites from the exchanged $NH_4$ZSM-5 was washed free of chloride ion, dried at 230° F., and calcined for 10 hours at 1000° F.

The resulting HZSM-5 was composited with a commercial reforming catalyst containing 0.35 wt. % Pt on an eta-alumina base. Compositing was achieved by ball-milling for two hours. The reforming catalyst was pre-milled alone in a ball mill for 24 hours prior to compositing with the HZSM-5. The final composite was pelleted by slugging to form ½" diameter pellets which were crushed and sized to 14 to 25 mesh. These particles had an apparent density of 0.76 g/cc.

The reforming activity of this catalyst was tested with a pretreated $C_6$-330° F. Kuwait naphtha as the charge stock (see Table 4). The results of this test are summarized in Table 5. The conditions of the run are shown in the table. This catalyst, which contains 10% HZSM-5 (by weight) produced 37.7% $C_5$+ liquid product at an aromatic level of 80.2 weight percent for the 12 liquid hourly space velocity (LHSV) run. At 50 LHSV, the $C_5$+ product has increased to 56.9% and the aromatics level approached 50%, with excellent gaseous product distribution.

The commercial platinum rhenium catalyst in Table 6 at 1.5 liquid hourly space velocity (LHSV) produced 68.4% $C_5$+ liquid product at an aromatic level of 54.6 weight percent. Based on charge it gave 13.3 weight percent $C_3$ plus $C_4$ product while the 10% HZSM-5 catalyst of Table 5 gave 36.3 weight percent $C_3$ plus $C_4$ product. Clearly, the catalyst of this invention is far superior to the commercial Pt-Re catalyst for producing $C_3$ plus $C_4$ product. Further, the $C_1$ plus $C_2$ product from the commercial Pt-Re catalyst of Table 6 was 9.8% of the charge naphtha while the corresponding yield from the 10% HZSM-5 catalyst of Table 5 was 3.1 weight percent. The catalyst of this invention shows both a decreased yield of $C_1$ plus $C_2$ product and an increased yield of $C_3$ plus $C_4$ product.

TABLE 4

Physical Properties of Hydrodesulfurized Reforming Naphtha Feed[1]

| Naphtha Source | $C_6$-330° F. Kuwait Naphtha | $C_6$-330° F. Arabian Light Naphtha | $C_6$-330° F. Mid-Continent Naphtha |
|---|---|---|---|
| Specific Gravity | 0.7286 | 0.7303 | 0.7511 |
| Molecular Weight | 110 | 108 | 111.07 |
| Sulfur, ppm | 1.0 | — | — |
| Nitrogen, ppm | <0.2 | — | — |

TABLE 4-continued

| Naphtha Source | Physical Properties of Hydrodesulfurized Reforming Naphtha Feed[1] | | |
|---|---|---|---|
| | $C_6$-330° F. Kuwait Naphtha | $C_6$-330° F. Arabian Light Naphtha | $C_6$-330° F. Mid-Continent Naphtha |
| Chlorine, ppm | <0.1 | — | — |
| Wt. % Combined Hydrogen | — | — | 14.23 |
| Composition, vol. % | | | |
| $C_4$ and lighter | trace | trace | — |
| $iC_5$ | 0.1 | 0.1 | — |
| $nC_5$ | 0.5 | 0.8 | — |
| $C_6$ Plus | 99.6 | 99.1 | — |
| Composition, wt. % | | | |
| Paraffins | 68.0 | 66.7 | 44.6 |
| Monocycloparaffins | 19.5 | 19.5 | 35.7 |
| Dicycloparaffins | 1.1 | 0.4 | 3.9 |
| Aromatics | 11.4 | 13.1 | 15.8 |
| Research Octane Number (RON + 0) | 49 | 39 | 51 |

[1]Naphtha referred to herein was pretreated with pure hydrogen at 500 psig, 700° F., 5 LHSV over a commercial cobalt molybdena hydrotreating catalyst.

TABLE 5

| $C_6$-330° F. Kuwait Naphtha Reforming Over HZSM-5/Pt/$Al_2O_3$[1] | | | |
|---|---|---|---|
| Catalyst | Fresh Catalyst of Example 1 | | |
| Temp. °F. | 900 | 900 | 900 |
| LHSV | 12 | 50 | 50 |
| Hydrogen/Hydrocarbon mole ratio | 7/1 | 7/1 | 7/1 |
| Pressure, psig | 200 | 200 | 200 |
| Hours on Stream | 4.5 | 5 | 24 |
| Weight Charge Naphtha, grams | 2.19 | 2.19 | 2.19 |
| Weight Product, grams | 2.04 | 2.07 | 2.12 |
| Liquid, grams | 0.81 | 1.19 | 1.23 |
| Gas, Hydrocarbon, grams | 1.23 | 0.88 | 0.89 |
| Wt. % Recovery | 93.4 | 94.5 | 97.0 |
| Wt. % $C_5^+$ | 37.7 | 55.1 | 56.9 |
| Wt. % $C_4^-$ | 55.8 | 39.4 | 40.1 |
| Wt. % Arom. in $C_5^+$ | 80.2 | 49.9 | 48.2 |
| Gas Composition, Wt. % | | | |
| $C_1$ | 1.6 | 0.8 | 0.7 |
| $C_2$ | 11.4 | 6.6 | 7.0 |
| $C_3$ | 66.7 | 66.7 | 67.5 |
| $C_4$ | 19.2 | 24.1 | 23.1 |
| $C_5$ | 1.1 | 1.7 | 1.6 |
| Cat. Vol. (cc) | 0.55cc | 0.12cc | 0.12cc |

[1]The properties of the charge stock used in these runs are listed in Table 4.

TABLE 6

| $C_6$-330° F. Kuwait Naphtha Reforming[1] | | |
|---|---|---|
| Catalyst | Commercial Catalyst[2] Pt/Re/$Al_2O_3$ | |
| Temp. °F. | 940 | 940 |
| LHSV | 1.5 | 1.5 |
| Hydrogen/Hydrocarbon mole ratio | 7/1 | 7/1 |
| Pressure, psig | 200 | 200 |
| Hours on Stream | 22 | 45 |
| Weight Charge, grams | — | 2.19 |
| Weight Product, grams | — | 2.01 |
| Liquid, grams | — | 1.49 |
| Gas, grams | — | 0.52 |
| Wt. % Recovery | — | 91.8 |
| Wt. % $C_5^+$ | — | 68.4 |
| Wt. % $C_4^-$ | — | 23.4 |
| Wt. % Arom. in $C_5^+$ | 62.8 | 54.6 |
| Gas Composition, Wt. % | | |
| $C_1$ | 15.4 | 9.8 |
| $C_2$ | 45.4 | 32.3 |
| $C_3$ | 32.6 | 40.9 |
| $C_4$ | 6.3 | 15.9 |

TABLE 6-continued

| $C_6$-330° F. Kuwait Naphtha Reforming[1] | | |
|---|---|---|
| Catalyst | Commercial Catalyst[2] Pt/Re/$Al_2O_3$ | |
| $C_5$ | 0.3 | 1.1 |

[1]The properties of the charge stock used in these runs are listed in Table 4.
[2]The catalyst contained 0.35% by weight of each of platinum and rhenium. The alumina used was eta alumina having a crystal size of 40–60 Angstroms.

EXAMPLE 2

In preparing this catalyst containing 2% wt. HZSM-5 and 98 wt. % commercial Pt-alumina catalyst (containing 0.35% by weight of platinum), the individual components were prepared separately and then composited.

In this Example the ZSM-5 was synthesized by first prereacting the following solution:

A. Sodium silicate Solution
- 94.5 lbs. Q-Brand silicate
  - (28.9 wt. % $SiO_2$)
  - (8.9 wt. % $Na_2O$)
  - (62.2 wt. % $H_2O$)
- 54.9 lbs, water B. Acid Aluminum Sulfate Solution
- 3.02 lbs. $Al_2(SO_4)_3$ (17.2% $Al_2O_3$)
- 17.7 lbs. NaCl
- 7.88 lbs. $H_2SO_4$ (97%)
- 56 lbs. $H_2O$ These solutions were premixed in a nozzle and then added to the stirred autoclave. To this mixture in the autoclave was added 10.5 lbs. Methyl ethyl ketone
6.36 lbs. tripropyl amine
5.47 lbs. n-propyl bromide and reacted in the static state with no mixing. During the organic reaction the autoclave was heated to 240° F. and held for 14–15 hours to allow the organics and the gel to pre-react.

The mixture was then agitated vigorously and heated to and held at 320° F. for 4½ hours. The volitile organics were distilled off of the mixture at this point.

The crystalline product was separated from the supernatent liquor by filtration, followed by water washing at about 190° F. to remove all soluble salts. The washed material was dried at 230° F. and was calcined for 3 hours at 700° F. in air to remove all carbonaceous material. The ammonium chloride base exchange of this calcined ZSM-5 consisted of 4-1 hours stirred contacts at 190°-200° F. with ammonium chloride using 5 ml of 5 wt. % ammonium chloride per gram of calcined ZSM-5. The slurry was filtered after each contact, followed by water washing free of chloride ion after last contact. The washed cake was subsequently dried at 230° F. and re-calcined for 10 hours at 1000° F.

The resulting HZSM-5 was composited with ball-milled commercial 0.35 wt. % Pt on eta-alumina catalyst as described under Examples 1 and 2, the relative quantities being such as to give 2% HZSM-5 in the final catalyst composite. The final catalyst pelleted and sized 14 to 25 mesh.

The reforming activity of this catalyst was tested with the $C_6$-330° F. Arabian Light Naptha described in Table 4 as a charge stock. The conditions of the run and the results are shown in Table 7.

TABLE 7

| Catalyst of Example 2 | | |
|---|---|---|
| Days on Stream | 1 | 6 |
| Temp., °F. | 900 | 898 |
| Pressure, psig | 200 | 205 |
| LHSV | 1.52 | 1.51 |
| H/HC mole ratio | 7/1 | 7/1 |
| $C_5^+$, RON + O | 103.3 | 102.7 |
| $C_6^+$, RON + O | 110.6 | 110.7 |
| $C_5^+$ Yield (vol %) | 32.1 | 32.3 |
| wt % Results | | |
| $H_2$ | — | — |
| $C_1$ | 0.9 | 1.0 |
| $C_2$ | 6.6 | 6.5 |
| $C_3$ | 35.6 | 36.1 |
| $iC_4$ | 9.4 | 9.7 |
| $nC_4$ | 13.1 | 13.4 |
| $iC_5$ | 4.4 | 4.7 |
| $nC_5$ | 2.9 | 3.2 |
| $C_6^+$ Yield (wt %) | 28.1 | 27.4 |
| wt. % Recovered | 93.9 | 92.3 |

The clear research octane of the $C_5$ plus product, was 103. The $C_1$ plus $C_2$ yield was low 7.5 weight percent and the $C_3$ plus $C_4$ yield was a very high 59 weight percent.

EXAMPLE 3

This Example illustrates the preparation and use of TEA mordenite (a mordenite synthesized to contain quaternary ammonium ions) in the practice of this invention.

Three solutions were prepared as follows:

| | |
|---|---|
| Solution A | |
| Sodium aluminate (41.8 weight percent $Al_2O_3$) 31.3 weight percent $Na_2O$ | 4.7 grams |
| Solution B | |
| tetraethylammonium chloride solution 50% | 44.7 grams |
| sodium hydroxide (77.5 wt. % $Na_2O$) | 4.87 grams |
| Solution C | |
| colloidal silica (Ludox) (30 wt. % $SiO_2$) | 118.1 grams |

Solution A was added to Solution B and then Solution C was introduced into the combined mixture of Solutions A and B and the resultant mixture was mixed for 15 minutes. The composition of the mix, Solutions A, B and C, in terms of mole ratios of oxides, was as follows:

$$3.16TEA_2O:1.21Na_2O:Al_2O_3:30.6SiO_2:6.3\text{-}2NaCl:31.5H_2O$$

This was charged to an autoclave where it was maintained at a temperature of between 310° and 332° F. and under autogenous pressure for about eitht days. The crystals which crystallized from solution were washed until the filtrate showed a pH below about 11. The crystals were dried and analyzed. X-ray analysis showed the crystal structure of mordenite.

The sample was analyzed chemically and revealed the following chemical composition.

| | |
|---|---|
| N | 1.13 weight percent |
| Na | 1.0 weight percent |
| $Al_2O_3$ | 4.9 weight percent |
| $SiO_2$ | 91.8 weight percent |

The product analysis, in terms of mole ratios of oxides, was as follows:

$$0.84TEA_2:0.46Na_2O:Al_2O_3:31.7SiO_2$$

The crystals were air calcined for 10 hours at 1000° F. and the sorption properties were redetermined. The calcined crystals sorbed 7.7 weight percent cyclohexane, 7.0 weight percent normal hexane and 9.1 weight percent water.

Four-tenths (0.40) g. of a powdered $H^+$ (TEA) mordenite of this Example was mixed with 22.5 g. of powdered platinum on eta alumina catalyst (containing 0.35% Pt). The $Pt/Al_2O_3$ catalyst prior to mixing with zeolite was powdered by ballmilling for 24 hours. The powdered mixture was thoroughly mixed, pelleted and sized to 14×25 mesh particles.

Twenty cc of catalyst was placed in an isothermal reforming test reactor heated to 900° F. in hydrogen at 200 psig and then sulfided with an $H_2S$ hydrogen (40 ppm $H_2S$) mixture. Charge naphtha was passed over the catalyst at 1.5 LHSV, at 200 psig and 900° F. at a 7/1 mole ratio of hydrogen to hydrocarbon. The product districutions and liquid octanes were determined. Data from the evaluation of $H^+$ ((TEA) mordenite are shown in Table 8.

TABLE 8

Naphtha Reforming Over 2 Wt. % $H^+$ (TEA) Mordenite in 98 Wt. % (0.35 wt. % Pt on eta Alumina)

| | $C_6$-360° F. Mid-Continent Naphtha(2) | | | | | |
|---|---|---|---|---|---|---|
| Days on Stream | 1 | 6 | 9 | 14 | 19 | 22 |
| LHSV | 1.47 | 1.48 | 1.58 | 1.48 | 1.47 | 1.55 |
| $C_5^+$ Clear Research Octane | 101.5 | 101.7 | 100.8 | 100.7 | 101.0 | 100.1 |
| $C_6^+$ Clear Research Octane | 103.2 | 103.3 | 102.4 | 104.8 | 104.5 | 104.2 |
| $C_5^+$ Yield (vol. %) | 67.2 | 69.5 | 67.4 | 67.6 | 65.4 | 68.2 |
| Product Composition (wt. %) | | | | | | |
| $H_2$ | 1.7 | 2.0 | 1.8 | 1.4 | 1.3 | 1.2 |
| $C_1$ | 0.6 | 0.4 | 0.4 | 0.6 | 0.6 | 0.5 |
| $C_2$ | 1.6 | 1.5 | 1.4 | 1.8 | 1.6 | 1.6 |
| $C_3$ | 11.1 | 9.9 | 10.4 | 10.3 | 11.5 | 10.4 |
| $iC_4$ | 7.1 | 5.7 | 7.6 | 7.4 | 8.4 | 7.5 |
| $nC_4$ | 5.4 | 5.2 | 5.1 | 6.7 | 6.6 | 6.6 |
| $iC_5$ | 3.8 | 2.3 | 3.7 | 6.6 | 6.1 | 6.2 |
| $nC_5$ | 1.6 | 1.9 | 1.5 | 4.0 | 3.3 | 4.3 |
| | $C_6$-360° F. Mid-Continent Naphtha | | | $C_6$-330° F. Arabian Lt. Naphtha(1) | | |
| Days on Stream | 26 | 29 | 34 | 36 | 39 | 40 |

TABLE 8-continued

| Naphtha Reforming Over 2 Wt. % $H^+$ (TEA) Mordenite in 98 Wt. % (0.35 wt. % Pt on eta Alumina) | | | | | | |
|---|---|---|---|---|---|---|
| LHSV | 1.40 | 1.64 | 1.49 | 1.58 | 1.53 | 1.53 |
| $C_5^+$ Clear Research Octane | 100.2 | 100.2 | 100.0 | 94.0 | 94.0 | 94.8 |
| $C_6^+$ Clear Research Octane | 104.6 | 103.8 | 103.8 | 98.1 | 97.3 | 98.7 |
| $C_5^+$ Yield (vol. %) | 66.6 | 68.4 | 67.8 | 58.9 | 59.3 | 59.5 |
| Product Composition (wt. %) | | | | | | |
| $H_2$ | 1.0 | 1.1 | 1.0 | — | — | — |
| $C_1$ | 0.6 | 0.5 | 0.5 | 0.6 | 0.6 | 0.6 |
| $C_2$ | 1.7 | 1.4 | 1.6 | 2.0 | 2.0 | 2.1 |
| $C_3$ | 11.3 | 10.4 | 11.0 | 16.7 | 16.6 | 16.5 |
| $iC_4$ | 8.0 | 7.5 | 8.1 | 10.3 | 10.7 | 10.9 |
| $nC_4$ | 7.2 | 6.8 | 6.7 | 9.8 | 8.8 | 9.2 |
| $iC_5$ | 6.5 | 6.0 | 6.3 | 6.0 | 6.5 | 6.8 |
| $nC_5$ | 4.3 | 3.8 | 4.0 | 5.7 | 4.7 | 5.1 |

(1)Naphtha properties are listed in Table 4.
(2)Charge stock changed at 34 days on stream to the $C_6$-330° F. Arabian Light Naphtha.

A comparison of the results for the TEA mordenite of this Example with those in Examples 5 and 6 will show that the TEA mordenite-containing catalyst gives a higher octane liquid product than $H^+$ mordenite. Also, while the $C_1$ plus $C_2$ yields using the two catalysts are about the same, the catalyst containing the TEA mordenite gives much higher $C_3$ plus $C_4$ yields.

EXAMPLE 4

This Example illustrates the preparation and use of ZSM-38.

Illustrating the preparation of synthetic zeolite ZSM-38, a first solution comprising 17.7 g. sodium aluminate (41.8% $Al_2O_3$, 31.6% $Na_2O$ and 24.9% $H_2O$) 270 g. $H_2O$ and 21,6 g. NaOH was prepared. The organic material, choline chloride, was added to the first solution in 57.0 g. quantity to form a second solution. Thereupon, 390 g. colloidal silica (29.5% $SiO_2$ and 70.5% $H_2O$) was added to the second solution and mixed until a homogeneous gel was formed. This gel was composed of the following components in mole ratios:

| | | |
|---|---|---|
| $\frac{R^+}{R^+ + M^+}$ | 0.47, | wherein M is sodium and $R^+$ is choline chloride ion. |
| $\frac{OH^-}{SiO_2}$ | 0.281 | (Not including any contribution of $OH^-$ from choline chloride) |
| $\frac{H_2O}{OH^-}$ | 56.5 | (Not including any contribution of $OH^-$ from choline chloride) |
| $\frac{SiO_2}{Al_2O_3}$ | 26.5 | |

The mixture was maintained at 275° F. for 47 days, during which time crystallization was complete. The product crystals were filtered out of solution and water washed for approximately 16 hours on continuous wash line.

X-ray analysis of the crystalline product proved the crystals to have a diffraction pattern as shown in Table 9.

TABLE 9

| d(A) | I/Io |
|---|---|
| 9.5 ± 0.30 | Very strong |
| 7.0 ± 0.20 | Medium |
| 6.6 ± 0.10 | Medium |
| 5.8 ± 0.10 | Weak |
| 4.95 ± 0.10 | Weak |
| 3.98 ± 0.07 | Strong |

TABLE 9-continued

| d(A) | I/Io |
|---|---|
| 3.80 ± 0.07 | Strong |
| 3.53 ± 0.06 | Very strong |
| 3.47 ± 0.05 | Very strong |
| 3.13 ± 0.05 | Weak |
| 2.92 ± 0.05 | Weak |

Chemical analysis of the crystalline product led to the following compositional figures:

| Composition | Wt. % | Mole Ratio on $Al_2O_3$ Basis |
|---|---|---|
| N | 1.21 | — |
| Na | 0.76 | — |
| $Al_2O_3$ | 5.09 | 1.0 |
| $SiO_2$ | 92.4 | 29.9 |
| $N_2O$ | — | 1.00 |
| $Na_2O$ | — | 0.33 |
| $H_2O$ | — | 9.7 (from $H_2O$ adsorption) |

Physical analysis of the crystalline product of this example calcined 16 hours at 1000° F. showed it to have a surface area of 287 $m^2/g$ and adsorption tests produced the following results:

| Adsorption | Wt. % |
|---|---|
| Cyclohexane | 2.7 |
| n-Hexane | 5.1 |
| Water | 8.7 |

This catalyst was exchanged again with $NH_4Cl$ to further reduce the residual sodium content and was then blended with 98% wt. powdered platinum/alumina reforming catalysts containing 0.35 wt. % platinum. This mixture was pelleted and sized to 14×25 mesh particles.

Twenty cc of this mixture was placed in an isothermal reforming test reactor, heated to 200° F. in hydrogen at 200 psig and then sulfided with a $H_2S$/hydrogen (40 ppm $H_2S$) mixture. Charge naphtha (see Table 4) was passed over the catalyst at 1.5 LHSV, at 200 psig and 900° F. at a 7/1 mole ratio of hydrogen to hydrocarbon. The product distributions and liquid octanes were determined. Data are shown in Table 10. Large yields of $C_3$ plus $C_4$ paraffins are formed from both charge stocks and they give small yields of $C_1+C_2$.

The following Examples (5–8) are included merely for the purpose of comparison.

TABLE 10

| Reforming With 2 Wt. % ZSM-38 In 98 Wt. % 0.35 Pt/$Al_2O_3$ | | | | | | | | |
|---|---|---|---|---|---|---|---|---|
| | $C_6$-330° F. Arabian Light Naphtha(1) | | | | | $C_6$-360° F. Mid. Cont. Naphtha(1) | | |
| Days on Stream | 3 | 4 | 5 | 6 | 7 | 10 | 11 | 12 |
| Temperature | 901 | 899 | 899 | 900 | 899 | 898 | 896 | 896 |
| Pressure | 200 | 200 | 200 | 200 | 200 | 200 | 200 | 200 |
| LHSV | 1.48 | 1.50 | 1.50 | 1.50 | 1.49 | 1.52 | 1.52 | 1.51 |
| $C_5^+$ RON + O | 97.2 | 97.7 | 97.3 | 97.5 | 96.7 | 101.2 | 101.2 | 101.6 |
| $C_6^+$ RON + O | 100.6 | 100.8 | 100.5 | 100.5 | 99.9 | 102.9 | 103.4 | 104.1 |
| $C_5^+$ Yield (vol. %) | 48.2 | 49.2 | 48.5 | 49.6 | 47.3 | 61.3 | 63.0 | 63.4 |
| Wt. % Results | | | | | | | | |
| $H_2$ | 0.4 | 0.5 | 0.4 | 0.4 | 0.9 | 2.4 | 2.3 | 1.4 |
| $C_1$ | — | 0.5 | 0.5 | 0.5 | 0.5 | 0.4 | 0.4 | 0.4 |

TABLE 10-continued

| Reforming With 2 Wt. % ZSM-38 In 98 Wt. % 0.35 Pt/$Al_2O_3$ | | | | | | | | |
|---|---|---|---|---|---|---|---|---|
| | $C_6$-330° F. Arabian Light Naphtha[1] | | | | | $C_6$-360° F. Mid. Cont. Naphtha[1] | | |
| $C_2$ | 3.2 | 2.6 | 2.5 | 2.5 | 2.5 | 1.6 | 1.6 | 1.6 |
| $C_3$ | 21.0 | 20.5 | 20.9 | 20.4 | 20.6 | 12.2 | 12.5 | 12.2 |
| $iC_4$ | 13.0 | 12.8 | 13.4 | 12.9 | 13.0 | 8.6 | 8.6 | 8.6 |
| $nC_4$ | 10.0 | 9.4 | 9.8 | 9.4 | 9.5 | 5.5 | 5.7 | 7.2 |
| $iC_5$ | 5.0 | 4.7 | 4.9 | 4.7 | 4.8 | 2.9 | 2.9 | 5.8 |
| $nC_5$ | 3.0 | 2.8 | 2.9 | 2.8 | 2.9 | 1.8 | 1.8 | 1.8 |
| $C_6$+ Yield (wt. %) | 44.0 | 45.8 | 44.4 | 45.8 | 44.9 | 64.4 | 63.9 | 60.6 |
| Wt. % Recovered | 91.2 | 91.1 | 97.2 | 90.6 | 90.6 | 94.2 | 92.2 | 92.1 |

[1]See Table 4 for properties

EXAMPLE 5

A catalyst was prepared by compositing 1.0 gram (2%) of acid mordenite with 56.3 grams (90%) of commercial reforming catalyst containing 0.35 wt. % Pt on eta-alumina base. Compositing was achieved by ball-milling for two hours. The reforming catalyst was pre-milled alone in a ball mill for 24 hours prior to compositing with the acid mordenite. The acid mordenite used was a sample obtained from the Norton Company designated Zeolon H with a silica to alumina mole ratio of 12/1.0. After ballmilling the composite was pelleted and sized 14×25 mesh. This catalyst was evaluated with a $C_6$-330° F. Arabian Light naphtha described in Table 4. The conditions and results of this test are discussed in Table 11.

The conditions and charge stock run here are identical with the conditions of the test described in Example 2. The $C_5$+ liquid product from this run had an octane of 90 versus a 103 octane for the catalyst of Example 2. The mordenite catalyst of this example makes only 17 to 19 wt. % $C_3$+$C_4$ product versus the 59 wt. % $C_3$+$C_4$ product from the HZSM-5 catalyst of Example 2. Clearly the ZSM-5 catalyst makes more $C_3$+$C_4$ product and a higher octane liquid product under the same conditions.

The conditions run here are also similar and the charge stock identical to those used in Ex. 3, Table 8. The $C_5$+ liquid product from this run had an octane No. of 90 versus 94 for the catalyst of Example 3. The TEA mordenite catalyst of Ex. 3 makes 36 wt. % $C_3$+$C_4$ product versus the 17–19 wt. % $C_3$+$C_4$ product from the normal mordenite catalyst of this example. Clearly the H+ (TEA) mordenite catalyst makes much more $C_3$+$C_4$ product and a higher octane liquid product under the same conditions.

TABLE 11

Naphtha Reforming over 2% wt Mordenite in 98% wt (0.35% wt Pt on eta Alumina)
Temp. 900° F.; Pressure, 200 psig; $H_2$/Hydrocarbon mole ratio = 7/1

| Days on Stream | 4 | 5 | 6 |
|---|---|---|---|
| LHSV | 1.48 | 1.49 | 1.49 |
| $C_5$+ Clear Research Octane | 90.5 | 90.5 | 89.5 |
| $C_6$+ Clear Research Octane | 91.3 | 91.9 | 90.8 |
| $C_5$+ Yield (vol %) | 73.8 | 76.2 | 77.4 |
| Product Composition (wt %) | | | |
| $H_2$ | 1.2 | 1.1 | 1.1 |
| $C_1$ | 0.8 | 0.8 | 0.7 |
| $C_2$ | 1.6 | 1.6 | 1.6 |
| $C_3$ | 6.6 | 6.3 | 5.8 |
| $iC_4$ | 6.6 | 6.3 | 5.8 |
| $nC_4$ | 5.7 | 5.0 | 5.2 |
| $iC_5$ | 2.6 | 5.3 | 5.2 |
| $nC_5$ | 2.3 | 3.9 | 4.1 |

TABLE 11-continued

Naphtha Reforming over 2% wt Mordenite in 98% wt (0.35% wt Pt on eta Alumina)
Temp. 900° F.; Pressure, 200 psig; $H_2$/Hydrocarbon mole ratio = 7/1

| | | | |
|---|---|---|---|
| $C_6^{30}$ | 72.4 | 69.7 | 70.6 |

EXAMPLE 6

A catalyst was prepared by compositing 1.15 grams (2%) of acid mordenite with 49.15 grams of a commercial reforming catalyst containing 0.35 weight percent platinum and 0.2 weight percent rhenium on a gamma-alumina base with 0.9% chloride. The acid mordenite used was a commercially available sample obtained from the Norton Company designated Zeolon H Type 100 having a silica to alumina molar ratio of 10/1. The reforming catalyst was pre-milled alone in a ball mill for 24 hours prior to compositing with the acid mordenite. The composite was ballmilled for 2 hours and pelleted and sized 14×25 mesh. This catalyst was tested with a $C_6$-330° F. Arabian Light Naphtha described in Table 4. The conditions shown in Table 12 give a $C_5$+ liquid product having an octane of 99.4. These conditions give a $C_3$ plus $C_4$ product yield of 18 wt. percent. This mordenite catalyst run under conditions much more severe than the mordenite catalyst in Example 5 fails to approach the capability of the catalysts of this invention for making high yields of $C_3$ plus $C_4$ product plus a high octane liquid product as shown in Examples 1–4.

TABLE 12

Reforming With a 2% H+ Mordenite - 98% Pt-Re on Gamma Alumina Catalyst. Charge Stock: $C_6$-330° F. Arabian Light Naphtha described in Table 4

| | |
|---|---|
| Days on Stream | 2 |
| Temperature °F. | 960 |
| Pressure, psig | 150 |
| LHSV | 1.8 |
| H/HC ratio | 7.3 |
| $C_5$+ Clear Research Octane | 99.4 |
| $C_6$+ Clear Research Octane | 102.6 |
| $C_5$+ Yield (vol. %) | 70.1 |
| Product Composition (wt. %) | |
| $H_2$ | 1.9 |
| $C_1$ | 1.3 |
| $C_2$ | 2.8 |
| $C_3$ | 7.8 |
| $iC_4$ | 5.1 |
| $nC_4$ | 5.1 |
| $iC_5$ | 5.4 |
| $nC_5$ | 3.9 |
| $C_6$+ | 66.7 |

EXAMPLE 7

The commercial platinum (0.35 wt. %)-rhenium (0.20 wt.%) catalyst used in Example 6 converts a $C_6$-330° F. Arabian Light Naptha (See Table 4) under conditions specified in Table 13 to give a product as described in that table. The $C_5$+ liquid product has a clear octane of 103 which is the same as the product obtained in Example 2 from the catalyst of this invention.

TABLE 13

Kinetic Model Predicted Yields for Pt-Re/gamma-Alumina With $C_6$-365° F. Arabian Light Naphtha

| | |
|---|---|
| Temperature °F. | 960 |
| Pressure (psig) | 200 |
| LHSV | 1.3 |

TABLE 13-continued

| Kinetic Model Predicted Yields for Pt-Re/gamma-Alumina With $C_6$-365° F. Arabian Light Naphtha | |
|---|---|
| H/HC Ratio | 7 |
| $C_5$+ Clear Research Octane | 103 |
| $C_6$+ Clear Research Octane | 107 |
| $C_5$+ Yield (vol. %) | 58.6 |
| Product Composition (wt. %) | |
| $H_2$ | 1.1 |
| $C_1$ | 5.9 |
| $C_2$ | 6.4 |
| $C_3$ | 9.9 |
| $iC_4$ | 5.4 |
| $nC_4$ | 6.7 |
| $iC_5$ | 6.4 |
| $nC_5$ | 3.0 |
| $C_6$+ | 55.2 |

The data below show the superiority of the Example 2 yields of $C_3$ plus $C_4$ product:

| | HZSM-5 Catalyst of Example 2 | Pt-Re Catalyst of Example 7 |
|---|---|---|
| $C_1$ plus $C_2$ wt. % | 8 | 12 |
| $C_3$ plus $C_4$ wt. % | 59 | 22 |

Clearly the HZSM-5 catalyst gives a larger yield of desirable $C_3$ plus $C_4$ products and a smaller yield of $C_1$ plus $C_2$ products, which are considerably less valuable.

EXAMPLE 8

The following further illustrates that the composite of the present invention is unobviously superior to the mordenite/reforming catalyst of U.S. Pat. No. 3,544,451. This is shown by the higher octane number and the surprising increase in $C_3$ and $C_4$ yields.

SYNTHESIS OF MATERIALS

HZSM-5 (Unsteamed)

This is the catalyst of Example 2 prepared by compositing 2 weight percent zeolite in 0.35 weight percent platinum on eta alumina.

Mordenite

The mordenite catalyst is the catalyst of Example 5 prepared by compositing 0.35 weight percent platinum on eta alumina with 2 weight percent Zeolon H.

EVALUATION OF CATALYSTS

Twenty cc of the catalyst was placed in an isothermal reforming test reactor, heated to 900° F. in hydrogen at 200 psig and then sulfided with an $H_2S$/hydrogen (40 ppm $H_2S$) mixture.

Charge naphtha was passed over the catalyst at 1.5 LHSV, (liquid hourly space velocity) at 200 psig and 900° F. at a 7/1 mole ratio of hydrogen to hydrocarbon. Product distributions and liquid octanes were determined.

The charge stock used was a Mid-Continent $C_6$-360° F. naphtha pretreated in hydrogen at 500 psig, at 700° F. and at 5 LHSV over a commercial hydrotreating catalyst, cobalt molybdena. It had the properties set forth in Table 4.

The table below summarizes the results obtained.

TABLE 14

| | HZSM-5/Pt-$Al_2O_3$ | Mordenite/Pt-$Al_2O_3$ |
|---|---|---|
| Days on Stream | 13 | 13 |
| Temp., °F. | 897 | 900 |
| Pressure, psig | 200 | 200 |
| LHSV | 1.48 | 1.51 |
| $C_5$ + RON + O | 104.7 | 95.4 |
| $C_6$ + RON + O | 109.5 | 96.8 |
| $C_5$ + Yield (Vol. %) | 43.5 | 82.0 |
| Weight Results | | |
| $H_2$ | 0.4 | 2.1 |
| $C_1$ | 0.9 | 0.6 |
| $C_2$ | 5.4 | 1.1 |
| $C_3$ | 27.4 | 3.3 |
| $iC_4$ | 7.9 | 2.9 |
| $nC_4$ | 10.4 | 3.1 |
| $iC_5$ | 4.0 | 4.4 |
| $nC_5$ | 2.6 | 2.7 |
| $C_6$ + Yield | 41.1 | 79.8 |
| Wt. % Recovered | 89.5 | 96.4 |

What is claimed is:

1. A process for reforming which comprises contacting a naphtha charge stock under reforming conditions with a composite which comprises about 0.25% to about 25% by weight of ZSM-5 type zeolite and a platinum group metal reforming catalyst whereby there is produced a gaseous effluent containing a substantially increased yield of $C_3$ plus $C_4$ products and a substantially decreased yield of $C_1$ plus $C_2$ products as compared with reforming said naphtha charge under reforming conditions giving the same octane number liquid product in the presence of said platinum group metal reforming catalyst.

2. The process of claim 1 wherein said $C_3$ plus $C_4$ products are separated from the said gaseous effluent.

3. The process of claim 1 wherein the separated $C_3$ and $C_4$ products are further separated into the individual $C_3$ and $C_4$ components.

4. The process of claim 1 wherein the reforming catalyst comprises platinum on alumina.

5. The process of claim 1 wherein the reforming catalyst comprises platinum and rhenium on alumina.

6. The process of claim 1 wherein the zeolite has the pattern as set forth in Table 1.

7. The process of claim 1 wherein the zeolite has been exchanged with ammonium cations.

8. The process of claim 1 wherein said zeolite is present to the extent of from about 1% to about 15% by weight.

* * * * *

UNITED STATES PATENT AND TRADEMARK OFFICE

CERTIFICATE OF CORRECTION

PATENT NO. : 4,276,151

DATED : June 30, 1981

INVENTOR(S) : Plank et al.

It is certified that error appears in the above-identified patent and that said Letters Patent are hereby corrected as shown below:

Column 4, line 16, "ZSM" should be --ZSM-5--.

Column 6, line 36, after "the" insert --group--.

Column 6, line 48, "$R_1R_2R_3N+R_4X[R_1R_2R_3//R_4+N]X$" should be

--$R_1R_2R_3N + R_4X \longrightarrow [R_1R_2R_3R_4N]X$--.

Column 7, line 66, "catayti-" should be --catalyti---.

Column 15, line 2, "hours" should be --hour--.

Column 16, line 7, "eitht" should be --eight--.

Column 16, line 22, "0.84 $TEA_2$:0.46 $Na_2O$:$Al_2O_3$:31.7 $SiO_2$"

should be --0.84 $TEA_2O$:0.46 $Na_2O$:$Al_2O_3$:31.7 $SiO_2$--.

UNITED STATES PATENT AND TRADEMARK OFFICE

CERTIFICATE OF CORRECTION

PATENT NO. : 4,276,151

DATED : June 30, 1981

INVENTOR(S) : Plank et al.

It is certified that error appears in the above-identified patent and that said Letters Patent are hereby corrected as shown below:

Column 17, line 63, "d(A)" should be --$d(\mathring{A})$--.

Column 18, line 2, same as error immediately above.

Column 20, line 6, "$C_6$30" should be --$C_{6+}$--.

Signed and Sealed this

*Eighth* Day of *February 1983*

[SEAL]

*Attest:*

GERALD J. MOSSINGHOFF

*Attesting Officer* *Commissioner of Patents and Trademarks*